United States Patent [19]

Choi et al.

[11] 4,428,824

[45] Jan. 31, 1984

[54] PROCESS FOR VISBREAKING RESID DEASPHALTENES

[75] Inventors: Byung C. Choi; Benjamin Gross, both of Cherry Hill; Madhava Malladi, W. Deptford, all of N.J.

[73] Assignee: Mobil Oil Corporation, New York, N.Y.

[21] Appl. No.: 424,778

[22] Filed: Sep. 27, 1982

[51] Int. Cl.[3] ..... C10G 55/04
[52] U.S. Cl. ..... 208/86
[58] Field of Search ..... 208/86

[56] References Cited

U.S. PATENT DOCUMENTS

| | | | |
|---|---|---|---|
| 2,133,240 | 10/1938 | Atwell | 208/86 |
| 2,847,353 | 8/1958 | Beavon | 208/86 |
| 2,973,313 | 2/1961 | Pevere et al. | 208/86 |

*Primary Examiner*—Patrick Garvin
*Assistant Examiner*—Lance Johnson
*Attorney, Agent, or Firm*—Alexander J. McKillop; Michael G. Gilman; Charles J. Speciale

[57] ABSTRACT

A process is described for visbreaking a deasphalted hydrocarbon oil and subsequently reblending the recovered asphaltene fraction to produce a product of low viscosity and pour point and requiring less cutter stock oil as compared to conventional visbreaking processes.

9 Claims, 1 Drawing Figure

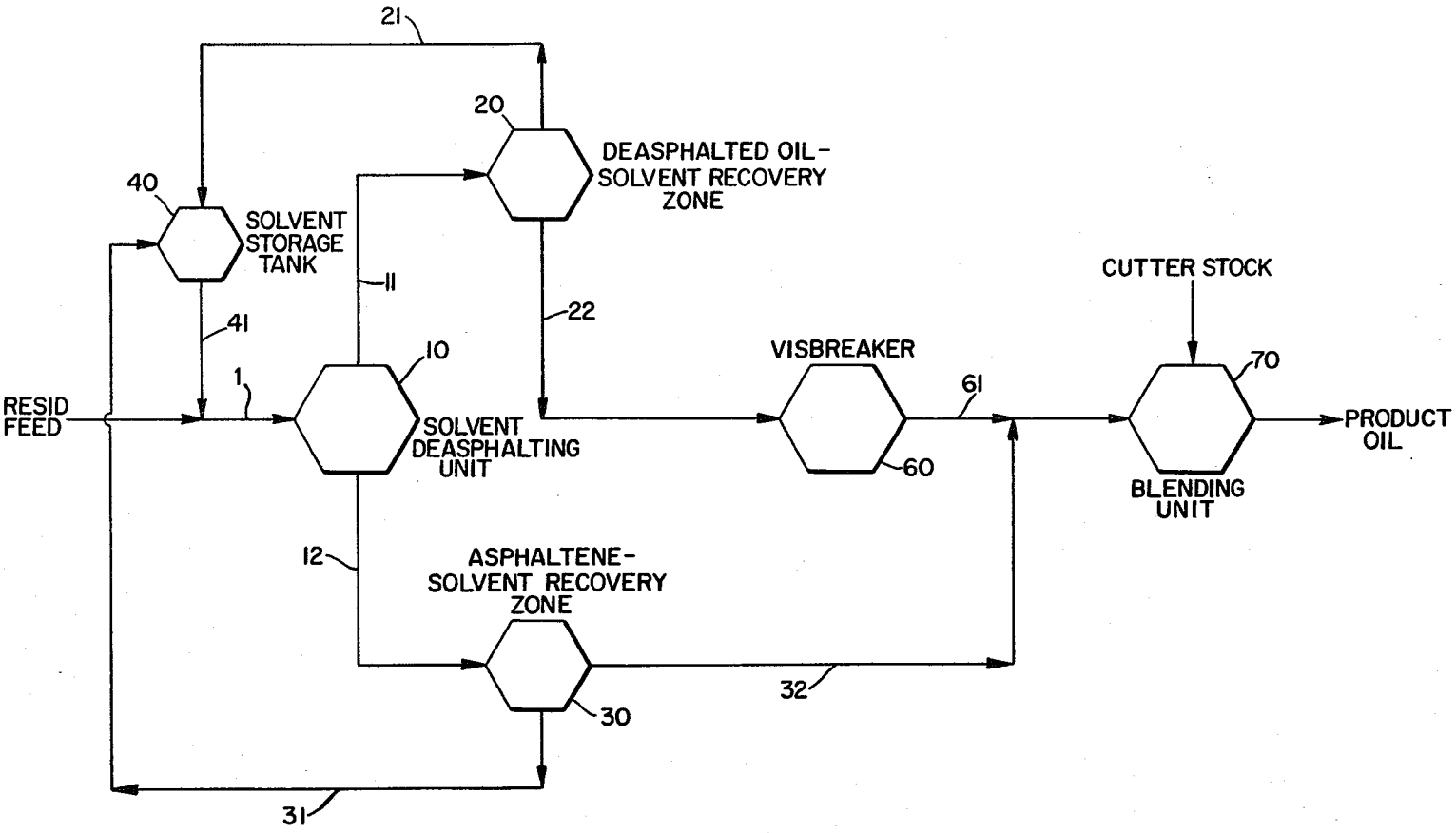
PRODUCT OIL
CUTTER STOCK
70
BLENDING UNIT
61
VISBREAKER
60
32
DEASPHALTED OIL-SOLVENT RECOVERY ZONE
22
20
21
SOLVENT DEASPHALTING UNIT
10
11
ASPHALTENE-SOLVENT RECOVERY ZONE
30
12
31
SOLVENT STORAGE TANK
41
1
40
RESID FEED

PROCESS FOR VISBREAKING RESID DEASPHALTENES

BACKGROUND OF THE INVENTION

This invention relates to the processing of deasphalted residual petroleum charge stocks and in particular to the visbreaking of such charge stocks.

2. Description of the Prior Art

Visbreaking, or viscosity breaking, is a well known petroleum refining process in which reduced crudes are pyrolyzed, or cracked, under comparatively mild conditions to provide products having lower viscosities and pour points thus reducing the amounts of less-viscous and more valuable blending oils required to make the residual stocks useful as fuel oils. In a typical visbreaking process, the crude or resid feed is passed through a heater and thereafter into a reaction chamber operating at from about 800° to about 975° F. and at about 50 to about 1000 psig. Light gas-oil is injected to lower the temperature of the effluent to within about 830° to about 850° F. Cracked products from the reaction chamber are introduced into a flash distillation unit with the vapor overhead being separated in a fractionating column into a light distillate overhead product, e.g., gasoline and light gas-oil bottoms, and the liquid bottoms being separated in a vacuum fractionating column into heavy gas-oil distillate and residual tar. Examples of such visbreaking methods are described in Beuther et al., "Thermal Visbreaking of Heavy Residues", *The Oil and Gas Journal.* 57:46, Nov. 9, 1959, pp. 151–157; Rhoe et al., "Visbreaking: A Flexible Process", *Hydrocarbon Processing,* January 1979, pp. 131–136; and U.S. Pat. No. 4,233,138 all of which are incorporated herein by reference. Heretofore, visbreaking has had only a limited efficiency when processing charge stocks containing asphaltenes. In conventional visbreaking of such charge stocks a sediment in the form of coke is formed which has the tendency to plug the visbreaker reactor, shorten production runs and result in unacceptably lengthy periods of down time. It has now been observed that visbreaking of such asphaltene-containing charge stocks is greatly enhanced when the petroleum charge stocks are deasphalted prior to entering the visbreaking unit.

Solvent deasphalting is a well-known operation in refineries. Primarily, deasphalting is used to separate a petroleum resid into a relatively high quality fraction (deasphalted oil or maltenes) and a lower quality fraction (asphalt or alphaltenes). Many solvents and solvent combinations have been suggested for this process. Most commonly, light hydrocarbon solvents or paraffins containing 3 to 8 carbon atoms in the molecule such as propane, propylene, butene, butane, pentene, pentane and mixtures thereof and used either alone or in admixture with other solvents such as ketones, liquid $SO_2$, cresol and diethyl carbonate. Typical or prior art deasphalting processes is the process described in U.S. Pat. No. 2,337,448 the entire contents of which are incorporated herein by reference. The prior art also covers examples of processes which incorporate visbreaking and deasphalting in that order.

U.S. Pat. No. 2,875,149 teaches a method for recovering asphaltenic constituents from a residual asphaltenic oil by visbreaking the residual oil and deasphalting the product formed.

U.S. Pat. No. 3,532,618 teaches a process for producing a pour point depressant for shale oil by contacting a deasphalting solvent under deasphalting conditions with the shale oil which has been previously hydro-visbroken.

By visbreaking a previously deasphalted resid followed by reblending the previously recovered asphaltene fraction, a high quality petroleum product of low viscosity and pour point is formed. In addition the problems associated with visbreaking asphaltene-containing resid feeds are eliminated by the removal of the asphaltenes. The removal of asphaltenes from the resid product prior to visbreaking eliminates coke formation which is largely due to condensation type of reactions of the asphaltenes. Therefore, the visbreaker will not be subjected to the problems associated with coke formation, such as reactor plugging, in the processing of the resid feed. Therefore the maltene fraction can be visbroken to a much higher severity than the whole resid feed and then can be recombined with asphaltenes resulting in a useful petroleum product of much lower viscosity and pour point and more compatible which in turn reduces the cutter stock requirements compared to conventional visbreaking.

SUMMARY OF THE INVENTION

The present invention describes an improved process wherein a petroleum residual product of low viscosity and pour point is produced by conventional visbreaking of a deasphalted residual petroleum charge stock, i.e., resid feed, followed by reblending the recovered asphaltene fraction. By separating out the asphaltenes from the maltenes prior to visbreaking, the visbreaker process efficiency is enhanced and the maltene fraction can be visbroken to a much higher severity than the whole resid feed. Upon reblending the asphaltene fraction to the visbroken maltene fraction, the product yields a compatible fuel oil product of much lower viscosity and pour point than that produced by conventional visbreaking. The process of this invention significantly reduces and may even eliminate the need for more valuable viscosity cutter stock required for making heavy fuel oil of the desired viscosity specification from a petroleum resid feed.

BRIEF DESCRIPTION OF THE DRAWINGS

The attached FIGURE represents a schematic diagram of the proposed invention.

DETAILED DESCRIPTION OF THE INVENTION

The concept of this invention utilizes the differences in kinetic behavior of asphaltene and maltene fractions in the resid feed to attain a higher reduction in resid viscosity and pour point while eliminating reactor coking and product incompatibility limitations. In a conventional visbreaking process coke formation and sedimentation phenomena are due to the changes which occur in asphaltene or asphaltene-maltene bonding. The process of the concept invention wherein the asphaltene fraction is separated from the maltene fraction prior to visbreaking severely restricts the coke formation in the resid thereby eliminating the visbreaker coil coking limitation. Coke formation is largely due to condensation type reactions of the asphaltenes. The process of this invention also reduces the tendency of sediment formation of the recombined product upon blending with the viscosity cutter stocks. This is due to the fact that, in this concept invention, the colloidal stability of the asphaltene fraction is kept intact by either exposing the asphaltenes to lower severities or by completely bypassing the asphaltenes visbreaking reactions. Therefore, the maltene fraction can be visbroken to a much higher severity than the whole resid feed. The severely-visbroken maltene fraction can then be recombined with the asphaltene fraction rendering a petroleum product of much lower viscosity and pour point than that attained by conventional visbreaking.

The resid feed contemplated in this invention comprises hydrocarbon oils boiling above 650° F. The oils include petroleum residua, coal-derived liquids, tar sands-derived liquids, shale oil and biomass-derived liquids.

Referring now to the drawing, the resid feed is first mixed with deasphalting solvent from line 41 and the combination is passed through line 1 to solvent deasphalting unit 10. A suitable deasphalting solvent in accordance with the practice of this invention is a light normal paraffin containing 3 to 8, and preferably 3 to 4, carbon atoms. Typical examples are ethane, ethylene, propane, propylene, normal butane, isobutane, n-butylene, isobutylene, pentane, isopentane and mixtures thereof. The solvent is added to the resid feed at a ratio of 1 to 20 by weight, preferably 3 to 12. The solvent deasphalting operation may be a batch operation, a multiple vessel operation or a substantially continuous liquid-liquid countercurrent treating operation wherein the vacuum bottoms to be deasphalted are introduced into the top of the deasphalting tower and flowed therein in liquid-liquid countercurrent contact with a suitable deasphalting solvent. The deasphalting operation is carried out at any suitable deasphalting temperature and pressure, the temperature and pressure being adjusted so as to maintain the deasphalting solvent in the liquid phase during the deasphalting operation. A deasphalting temperature in the range of 100° to 325° F. usually not more than 75° F. lower than the critical temperature of the deasphalting solvent, and a pressure in the range of 300 to 800 psig are employed depending upon the composition of the deasphalting solvent, and to a minor extent depending upon the composition of the vacuum bottoms undergoing deasphalting.

Following the deasphalting operation there is recovered from solvent deasphalting unit 10 a solvent deasphalted oil mix via line 11 and a solvent asphaltene mix via line 12. The solvent deasphalted oil mix is introduced by line 11 into deasphalted oil solvent recovery zone 20 wherein substantially all of the deasphalting solvent is removed by conventional means from the deasphalted oil and recycled via line 21 to solvent storage tank 40 where the solvent is stored until it is added to the resid feed. The resulting deasphalted oil is transferred from recovery zone 20 by line 22 to visbreaker 60 wherein the deasphalted oil is severely visbroken to lower its viscosity and pour point.

The visbreaking process of the present invention passes the deasphalted oil through a heater and thereafter into a reaction chamber operating at from about 750° to about 900° F. and at about 50 to about 1000 psig. Light gas-oil is injected to lower the temperature of the effluent to within about 650° to about 800° F. The maltene fraction is severely cracked in the reaction chamber. The advantage realized in the present invention results from the absence of the asphaltene fraction from the visbreaker feed stock. In a conventional visbreaker system coke is formed largely due to the condensation type reactions of the asphaltenes in the feed material. The coke formation is detrimental to the visbreaker system in that it tends to plug up the system thereby increasing down time and rendering the visbreaker commercially inefficient for asphaltene-containing feed stocks. By eliminating the asphaltene fraction from the feed stock the visbreaker operates far more efficiently thereby producing a visbroken deasphalted oil having a lower viscosity and pout point than that produced in a conventional visbreaking system. The visbroken deasphalted oil exits the visbreaker 60 by line 61.

The solvent-asphaltene fraction exits solvent deasphalting unit 10 via line 12 and is introduced into solvent-asphaltene recovery zone 30 wherein substantially all of the solvent is removed by conventional means from the asphaltene fraction and returned by line 31 to solvent storage tank 40 where it is stored until the solvent is added to the resid feed. The recovered asphaltene fraction exits recovery zone 30 via line 32 and is reblended with the visbroken deasphalted oil fraction at line 61. The reconstituted asphaltene-visbroken deasphalted oil fraction is subsequently blended with enough viscosity cutter stock oil to meet the desired viscosity specifications in blending unit 70. Due to the lower viscosity and pour point of the petroleum product, the cutter stock addition step may be omitted. The entire invention results in a petroleum product of low viscosity and pour point useful in the production of fuel oils.

Another embodiment of this invention resides in subjecting the asphaltene fraction exiting recovery zone 30 via line 32 to additional visbreaking prior to reblending with visbroken product exiting visbreaker 60 via line 61.

The invention will now be illustrated by examples. The examples are not to be construed as limiting the invention described by the present specification including the claims.

EXAMPLES 1 AND 2

Examples 1 and 2 were designed to show the results of a conventional visbreaking process. Arabian light vacuum residual oil was visbroken at 100 ERT secs. Visbreaker cutter stock oil was then added to two fractions of visbroken product oil in 15 and 50 wt.% increments respectively. The resulting blend was then subjected to a sediment test by Mobil's Centrifuge Method. In Mobil's Centrifuge Method, a representative sample of the suspended residual fuel oil is preheated if necessary and transferred to a preheated centrifuge (150° F.±2° F.) and centrifuged for 3 hours at a rate calculated to produce a relative centrifugal force of 700 units at the tip of tubes containing the oil. The proportion of sediment is then calculated with respect to the proportion of liquid.

The results of Examples 1 to 2 are shown on Table 1.

TABLE 1

| | Example 1 | Example 2 |
|---|---|---|
| Visbreaking Severity, ERT secs. | 1000 | 1000 |
| Product Kinematic Viscosity at 130° F., cs | 56.7 | 56.7 |
| Cutter Stock Added to Product, wt. % | 15 | 50 |
| Sediment Formed, Vol. % | 5.5 | 4.0 |

EXAMPLES 3-6

Examples 3-6 were designed to show the effects of deasphalting the residual feed oil prior to visbreaking.

Arabian light vacuum residual oil was deasphalted in a continuous unit using propane as a solvent. The deasphalting process was conducted at a solvent to residual oil ratio of 8 to 1 and at an average deasphalting temperature of 140° F. The properties of the recovered product are shown on Table 2.

TABLE 2

| Deasphalted Oil | |
|---|---|
| Initial Boiling Point, °F. | 775 |
| Asphaltene Yield with Propane, wt. % | 30 |
| Kinematic Viscosity at 130° F., cs | 550.6 |

The deasphalted fraction was visbroken in the manner of Examples 1 and 2. The asphaltene fraction was subsequently reblended to the deasphalted fraction and cutter stock was added in the amounts shown on Table 3. The products were then tested for sediment formation by the method described for Examples 1 and 2. The visbreaking severities and results are shown on Table 3.

TABLE 3

| Examples | 3 | 4 | 5 | 6 |
|---|---|---|---|---|
| Visbreaking Severity, ERT secs. | 1000 | 1000 | 1500 | 1500 |
| Product Kinematic Viscosity at 130° F., cs | 102.9 | 102.9 | 81.5 | 81.5 |
| Cutter Stock Added to the Product, wt. % | 15 | 50 | 15 | 50 |
| Sediment Formed, Vol. % | Tr* | Tr | Tr | Tr |

*Tr stands for trace amounts.

The results show that the product oils made by visbreaking residual oil to 1000 and 1500 ERT secs by the new process result in only trace amounts of sediment at both 15 and 50 wt.% cutter stock level whereas the same type of product oils obtained by conventional visbreaking (without deasphalting) at 1000 ERT secs produced 5.5 and 4.0 vol.% sediment respectively.

What is claimed is:

1. An improved process for producing a fuel oil from a resid feed, said process consisting essentially of:

(1) deasphalting said resid feed in the presence of a solvent to produce a deasphalted oil and an asphaltene fraction;

(2) visbreaking said deasphalted oil;

(3) reblending said asphaltene fraction into said deasphalted oil subsequent to said visbreaking; and (4) further blending the product of step (3) with viscosity cutter stock oil.

2. The process of claim 1 wherein said solvent comprises a paraffin within a $C_3$–$C_8$ range.

3. The process of claim 1 wherein the range of said solvent is within $C_3$–$C_4$.

4. The process of claim 1 wherein said solvent to said resid feed ratio ranges from 1 to 20 by weight.

5. The process of claim 1 wherein said solvent to said resid feed ratio is from 5 to 12 by weight.

6. The process of claim 1 wherein said solvent is removed from said deasphalted oil and said asphaltene fraction prior to visbreaking and recycled for use in step 1.

7. A process for the production of a fuel oil product of low viscosity and pour point said process consisting essentially of the following steps:

(1) deasphalting a resid feed in the presence of a solvent comprising a light normal paraffin within a $C_3$–$C_8$ range, said solvent to resid feed ratio ranging from 1 to 20 by weight to produce a deasphalted oil and asphaltene fraction;

(2) removing said solvent from said deasphalted oil and said asphaltene fraction;

(3) recycling said solvent for use in step 1;

(4) visbreaking said deasphalted oil;

(5) reblending said asphaltene fraction into said deasphalted oil fraction subsequent to visbreaking; and (6) further blending the product of step 5 with viscosity cutter stock oil.

8. The process of claim 7 wherein the range of said solvent is within $C_3$–$C_4$.

9. The process of claim 7 wherein the range of said solvent to resid ratio is from 5 to 12.

* * * * *